US009364716B2

(12) United States Patent
Kramer et al.

(10) Patent No.: US 9,364,716 B2
(45) **Date of Patent: *Jun. 14, 2016**

(54) PORTABLE MULTIPURPOSE FITNESS DEVICE

(71) Applicants: Eitan Kramer, New York, NY (US); Frank Bleck, Santa Barbara, CA (US); Eric Michael Bergman, Santa Barbara, CA (US)

(72) Inventors: Eitan Kramer, New York, NY (US); Frank Bleck, Santa Barbara, CA (US); Eric Michael Bergman, Santa Barbara, CA (US)

(73) Assignee: MORF, LLC, West Hollywood, CA (US)

( * ) Notice: Subject to any disclaimer, the term of this patent is extended or adjusted under 35 U.S.C. 154(b) by 111 days.

This patent is subject to a terminal disclaimer.

(21) Appl. No.: 14/067,914

(22) Filed: Oct. 30, 2013

(65) Prior Publication Data

US 2014/0121082 A1 May 1, 2014

Related U.S. Application Data

(60) Provisional application No. 61/720,140, filed on Oct. 30, 2012.

(51) Int. Cl.

| | |
|---|---|
| ***A63B 22/16*** | (2006.01) |
| ***A63B 26/00*** | (2006.01) |
| ***A63B 5/00*** | (2006.01) |
| ***A63B 22/18*** | (2006.01) |

(Continued)

(52) U.S. Cl.

CPC ..... *A63B 26/003* (2013.01); *A63B 5/00* (2013.01); *A63B 22/18* (2013.01); *A63B 23/1236* (2013.01); *A63C 17/0093* (2013.01); *A63C 17/014* (2013.01); *A63C 17/24* (2013.01); *A63B 21/0442* (2013.01); *A63B 21/0552* (2013.01); *A63B 21/0557* (2013.01); *A63B 21/4035* (2015.10); *A63B 23/03541* (2013.01); *A63B 2210/50* (2013.01); *A63B 2225/62* (2013.01); *A63C 2203/06* (2013.01)

(58) Field of Classification Search

CPC ..... A63C 17/01; A63B 22/20; A63B 26/003; A63B 26/006; A63B 23/1236; A63B 22/18; A63B 22/185; A63B 22/16

See application file for complete search history.

(56) References Cited

U.S. PATENT DOCUMENTS 3,604,726 A 9/1971 Tracy
3,716,229 A 2/1973 Van Der Cleyen et al.

(Continued)

FOREIGN PATENT DOCUMENTS

EP 2007486 1/2011

OTHER PUBLICATIONS

Cool Board Balance Board Web. Retrieved Oct. 29, 2015. <<https://coolboard.co.uk/>>.

(Continued)

*Primary Examiner* — Loan H Thanh
*Assistant Examiner* — Rae Fischer
(74) *Attorney, Agent, or Firm* — Mintz Levin Cohn Ferris Glovsky and Popeo, P.C.

(57) ABSTRACT

An exercise board with interchangeable center and lateral exercise accessories. The center modules include several different types of devices, each designed to be used for different exercises. The center modules can include a bounce ball, a base that makes the deck unstable, for core workout, and a flat unit that is flush with the deck. The side accessories can include handgrips, skateboard trucks, foot straps, or flat units.

11 Claims, 9 Drawing Sheets

(51) Int. Cl.

| | |
|---|---|
| ***A63B 23/12*** | (2006.01) |
| ***A63C 17/00*** | (2006.01) |
| ***A63C 17/01*** | (2006.01) |
| ***A63C 17/24*** | (2006.01) |
| *A63B 21/04* | (2006.01) |
| *A63B 21/055* | (2006.01) |
| *A63B 23/035* | (2006.01) |

(56) References Cited

U.S. PATENT DOCUMENTS

| | | | | |
|---|---|---|---|---|
| 4,073,356 | A * | 2/1978 | Schlicht | 180/181 |
| 4,893,809 | A | 1/1990 | Blankenzee | |
| 5,766,119 | A | 6/1998 | Clark | |
| 7,857,740 | B2 | 12/2010 | Suaste | |
| 8,267,845 | B2 | 9/2012 | Taylor et al. | |
| 2004/0087421 | A1 * | 5/2004 | Lin | A63B 1/0004 482/146 |
| 2012/0252644 | A1 | 10/2012 | Reade | |
| 2012/0264579 | A1 | 10/2012 | Klein et al. | |
| 2013/0184131 | A1 * | 7/2013 | Doyle | 482/139 |
| 2015/0238793 | A1 | 8/2015 | Kramer et al. | |

OTHER PUBLICATIONS

GOFIT Core Wobble Board Web. Retrieved Oct. 29, 2015. <<https://www.gofit.net/index.php/products/a---gofit-products/all-gofit-products-balance-sta. . . >>.

Hasbro Pogo Balls Web. Retrieved Oct. 29, 2015. <<http://www.ebay.com/itm/Space-Rock-N-Hopper-Logo-Pogo-Ball-Bounce-Hop-Brand/3 . . . >>.

Pp Plastic Balance Board Web. Retrieved Oct. 29, 2015. <<http://www.alibaba.com/product-detail/Plastic-Balance-board_586542666.html?spm=a27 . . . >>.

Reebok Trainpod Web. Retrieved Oct. 29, 2015. <<http://www.amazon.co.uk/Reebok-TrainPod/dp/B008UVIM10>>.

VS Athletics Balance Disc Cushion Web. Retrieved Oct. 29, 2015. <<https://www.vsathletics.com/store/Balance-Disc-Cushion.html>>.

* cited by examiner

PORTABLE MULTIPURPOSE FITNESS DEVICE

PRIORITY/CROSS-REFERENCE TO RELATED APPLICATIONS

This application claims the benefit of U.S. Provisional Application No. 61/720,140, filed Oct. 30, 2012, the disclosure of which is incorporated by reference.

TECHNICAL FIELD

The invention is in the fitness equipment field. More particularly, the invention is in the technical field of personal, portable, multipurpose, fitness equipment utilizing a base station and interchangeable components

BACKGROUND

Traditional fitness equipment is generally not portable or multipurpose, forcing those who seek personal fitness to invest in many different pieces of equipment or join gyms to get a total body workout. Additionally, traditional fitness equipment does not incorporate fun into the workout.

The present invention can be used anywhere, and it transforms exercise into play. The invention infuses the fun of jumping on a trampoline or pogo stick into a serious, multipurpose piece of fitness equipment. Interchangeable components allow the invention to be used as a total-body workout, using a bounce ball for jumping and cardiovascular work, handles on the base station for pushups, a balance board attachment for abdominal and balance exercises, an omni-directional abdominal (ab) ball for upper-body and abdominal strength training, a halo destabilizer for balance and coordination, and attachable skate board trucks to improve balance and coordination.

SUMMARY OF THE DISCLOSURE

The purpose of the Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the inventive concept(s) of the application, which is measured by the claims, nor is it intended to be limiting as to the scope of the inventive concept(s) in any way.

The main object of the present invention is to create a fun way for individuals to exercise in any location. Another object of the present invention is to provide an inexpensive piece of fitness equipment that can be used to achieve a total-body workout. Yet another object of the present invention is to provide interchangeable components that allow users to perform a wide range of cardiovascular, balance, and strength-training exercises. The device is also for training action sports athletes to perform better at their sports.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

The current inventive concepts create a fun way for individuals to exercise in any location. The concepts also provide an inexpensive piece of fitness equipment that can be used to achieve a total-body workout. This is accomplished by utilizing interchangeable components that allow users to perform a wide range of cardiovascular, balance and strength-training exercises.

The inventive concepts provide for a fitness platform having interchangeable parts. These parts allow for a variety of configurations and workouts. These configurations include a bounce shaped ball, skateboard trucks, an omni-directional ab ball, and other exercise attachments. The invention further incorporates handles to facilitate the performance of pushups and other exercises requiring gripping the platform.

One aspect of the exercise board of the disclosed technology is one that is configured for a user to use on a floor for exercise. It includes a deck, the deck having a top and bottom surface and a short and long axis. The long axis is longer than the short axis and at the intersection at the long and short axis the deck defines a through passage. The through passage is built to engage a center module, so that the center module is interchangeable among several different types of center modules, and thus removable from the deck.

The center module can be a generally resilient protuberance below the deck, and may or may not extend above the deck. The part of the center module which extends below the deck can be firm but resilient and provide a certain amount of bounce for springing motion when in contact with the floor below the device. One version of the center module is less springy and less bouncy, and provides a stable platform for exercises not involving rebound. The center module can also have rebound enhancing devices such as springs to cause greater rebound. The center module can include a mounting means such as a locking ring, which can be configured in various ways to removably lock the center module in place in the deck. The mounting means can be essentially a ring with extending arms which twist into a locking place by a quarter turn or quarter screw, into receiving slots or threads built into the deck. The center module can have portion that extends below the deck which can be rounded on the bottom or can be flat, or have a portion extending above the deck, with our without a hand grip. The locking means can be a bayonet type mount, in which tabs on the side of the locking ring fit into tabs in the deck, so that when the locking ring is rotated in one direction, the tabs lock into place in the deck. The center module can have a portion that protrudes above the deck surface and that portion can be a generally tubular section with a hand grip built into the end. It can also be generally flush with the top of the deck and not extend above the top of the deck.

The deck also defines a pair of lateral receiver position on either side of the mid region through passage. These lateral receiver positions are configured for locking an exercise accessory in place. The exercise accessory may be locked in place so that it rotates, or it may be solidly locked in place. One example of a lateral exercise accessory is a ring which has a hand grip in its center. The hand grips would be spaced at an appropriate distance from each other to provide a user a position to do pushups with the hand grips turned to various positions in order to exercise different muscle groups of the arms and shoulders. The lateral exercise accessory in the form of a hand grip can also be locked solidly in place into a preferred embodiment such as perpendicular to the long axis of the deck. Other examples of lateral exercise accessories can be a skate board truck with wheels which mounts in place in the lateral receiving positions, which makes the deck of the exercise board into a skate board. Another example of a lateral exercise accessory is one which is round and disc like and locks into place, flush with the deck, and has straps which engage the user's feet to hold them in place.

In one configuration of the disclosed technology, in one version of the deck, the end pieces of the deck are removable. In this version with the removable deck tips, with the deck tips removed the lateral exercise accessory is exposed and is able to slide out of its engagement with the deck. When the deck tips are installed around the lateral exercise accessory, the accessory is locked in place in the deck and ready for use. The deck can also include resistance band attachments which slip into prepared slots or attachment points in the deck. The band anchors are thus locked in place in the deck tips, and a cable may be attached to a fixed anchor position in order to create resistance for the user when maneuvering the base station. The deck may also include hand grip areas which are on the short axis of the deck, and adjacent to the center module. A version of the deck which has these supplemental hand grips could thus have four or five hand grip positions. The two supplemental hand grips, the two lateral exercise accessories in the form of hand grips, and the top part of the center module in the form of a hand grip.

The center module can be of a resilient rubber like material which protrudes below the deck as well as above the deck. The above the deck portion can have a hollow top with a hand grip region in the top. The center module can also be formed of a collar portion which locks in place an omni-directional ab ball, so that the ball may rotate like a ball at the end of a ball point pen, while supporting the deck. The above deck portion of this type of center module can be of a hard plastic and have a hand grip. Another version of the center module is one in which the portion below the deck is a flat bottom disc like shape, with little or no portion protruding above the deck. There are attachment options and devices for the center module as well as the lateral mounting positions. These optional devices can make the deck into a balance board, so that the user may balance over a cylinder which is free to rotate.

DETAILED DESCRIPTION OF PREFERRED EMBODIMENTS

Figure 1:
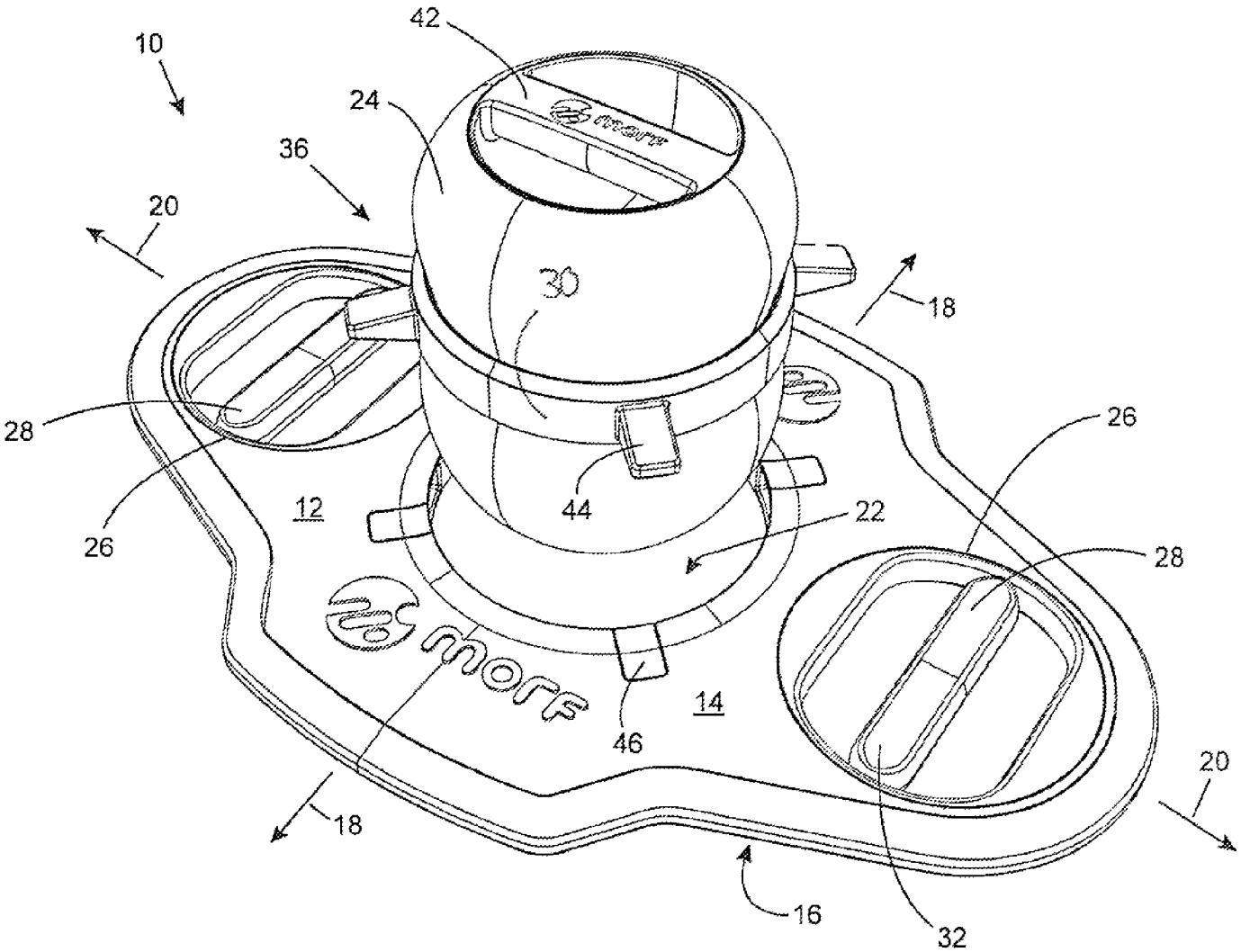
FIG. 1 is a perspective view of one embodiment of the disclosed device.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims. The claims define the disclosed technology, not the figures, and not the preferred embodiments.

Referring first to FIG. 1, the fitness device is comprised of a deck 12 with a round opening (a through passage 22) with a locking mechanism that allows users to quickly shift from one exercise mode to another by installing different attachments. Shown in FIG. 1 is an exercise board 10 of the disclosed technology, which includes a deck 12 with a top surface 14 and a bottom surface 16. The deck 12 includes a long axis 20 and a short axis 18. At the intersection of the long and short axis is located a through passage 22 which provides an opening in the center of the deck 12. The through passage 22 is configured to receive a center module 24, which can take various configurations. The center module 24 can extend below the deck 12, it can extend above the deck 12, it can be flush with the surface of the deck either above or below, and it can also be flush with both the top and bottom surface of the deck. This would be the case when the exercise device 10 is modified for use as a skateboard. This will be discussed in other figures. In the version of the center module shown in FIG. 1, the center module 24 can have a hand grip 42 at its top, above the deck.

The exercise board includes a mounting means 36 which can be a rotating ring 30 such as that shown in FIG. 1. In the mounting means of FIG. 1, extending tabs 44 extend out from the rotating ring 30 and fit into slots 46. The slots 46 can allow the rotating ring 30 to lock into place by a partial twist of the rotating ring, or they can fit into threads which allow the rotating ring 30 to be secured by threading it into place. Shown in FIG. 1 is a pair of lateral receiving positions 26. These are on either side of the center module 24, and are positions which are available for removable installation of a number of different types of lateral exercise accessories 28. In the view shown in FIG. 1, the lateral exercise accessory is a hand grip 32, but other types of lateral exercise accessories are available, and it is an important concept of the present device that the exercise board utilizes a center module selected from a number of available center modules, and lateral exercise accessories selected from a number of available lateral exercise accessories.

The board can be various sizes and shapes but in each configuration the deck 12 is longer in the long axis 20 than in the short axis 18. The deck can be made of a number of materials, including plastic, wood, graphite, aluminum, or other materials which are suitably strong and light for the intended purpose of exercise. The top side of the deck can be plastic polyethylene, and can have a textured surface for grip and aesthetic appeal. A typical configuration of the deck would be 26.7 in long, and 14.9 in wide, with a deck thickness of 0.78. The lateral receiver positions can be from 1.5 in to 3 inches in diameter, for example. The through passage 22 can be 8.6 inches to 10 inches in diameter, as an example.

The underside of the deck can be lined with hard plastic rails that allow the board to easily slide across any smooth surface. This allows users to perform a wide range of core-strengthening exercises and upper- and lower-body strength-training exercises, such as abdominal pikes, offset push with lateral extension, and reverse lunges.

The heart of the disclosed exercise device is the threaded locking system of the center module, a dual-phase mechanism that secures center module attachments. Center module units will push up or down into the deck 12 via the through passage 22, twist, and lock into place. Center module attachments remain locked in place until a release button or other release device, on the top or bottom side of the base station is depressed. Users can then remove attachments by twisting them out of the threaded opening, or bayonet.

Figure 2:
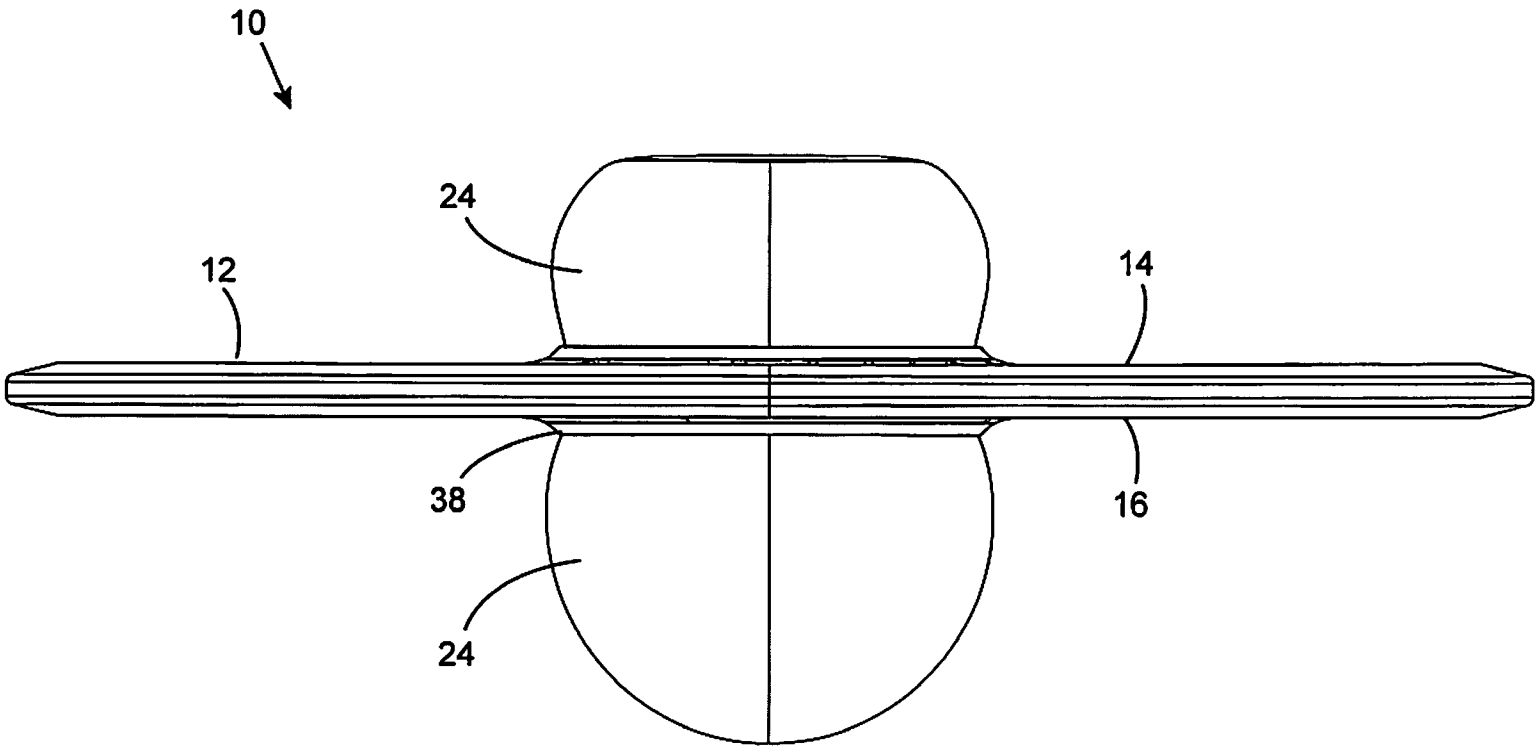
FIG. 2 is a side view of an embodiment of the disclosed technology.

Depending on the configuration that the user chooses to create with the exercise board, by combining different center modules 24 and different lateral exercise accessories 28, the side view of the device could look quite different than this. Shown in FIG. 2 in side view is a ring structure 38 which is one type of mounting means for securing the center module 24 to the deck 12. Also seen in FIG. 2 is a side view of a center module 24 which is made up of a lower half which is generally a half sphere, and a partial sphere on the top, above the deck. The upper portion has a top that is flat with a handle. This version of the center module 24 is called a bounce ball, and it is preferably inflated rather than solid. It is resilient and made of rubber or urethane.

The bounce ball creates a very unstable surface so that the user uses the motion of bouncing to develop balance, coordination and strength. Additionally, the bounce ball attachment develops the cardiovascular system as the bouncing action mimics that of a rebounder or mini trampoline. Bouncing will increase the user's heart rate, so the bounce ball attachment is well suited for interval training where users bounce vigorously for a short period of time to spike their heart rate, and then slow or stop the bounce to recover. The process is repeated for a desired period of intervals over a desired period of time. To bounce, the user stands on the deck. Foot straps can be used, or the feet can be placed over hand grips or handles, or the lateral receiver positions can be loaded with discs that cover the openings. To bounce, users can strap feet into the board using the lateral attachments or they can squeeze the above deck portion of the ball between their feet for grip. A small initial hop by the user can be built into larger bounces as the user initiates the bouncing movement. The topside is designed so the feet can wedge underneath the most bulbous part of the ball to give grip and control.

The bounce ball attachment version of the center module 28 can be used for both upper and lower body strength exercises such as pushups or squats. For a pushup, the hands can be anywhere on the deck, but they will most likely be used in the hand grip 32 configuration in the lateral attachment positions. Through these exercises, users develop greater balance, core strength, and engage stabilizer muscles.

Figure 3:
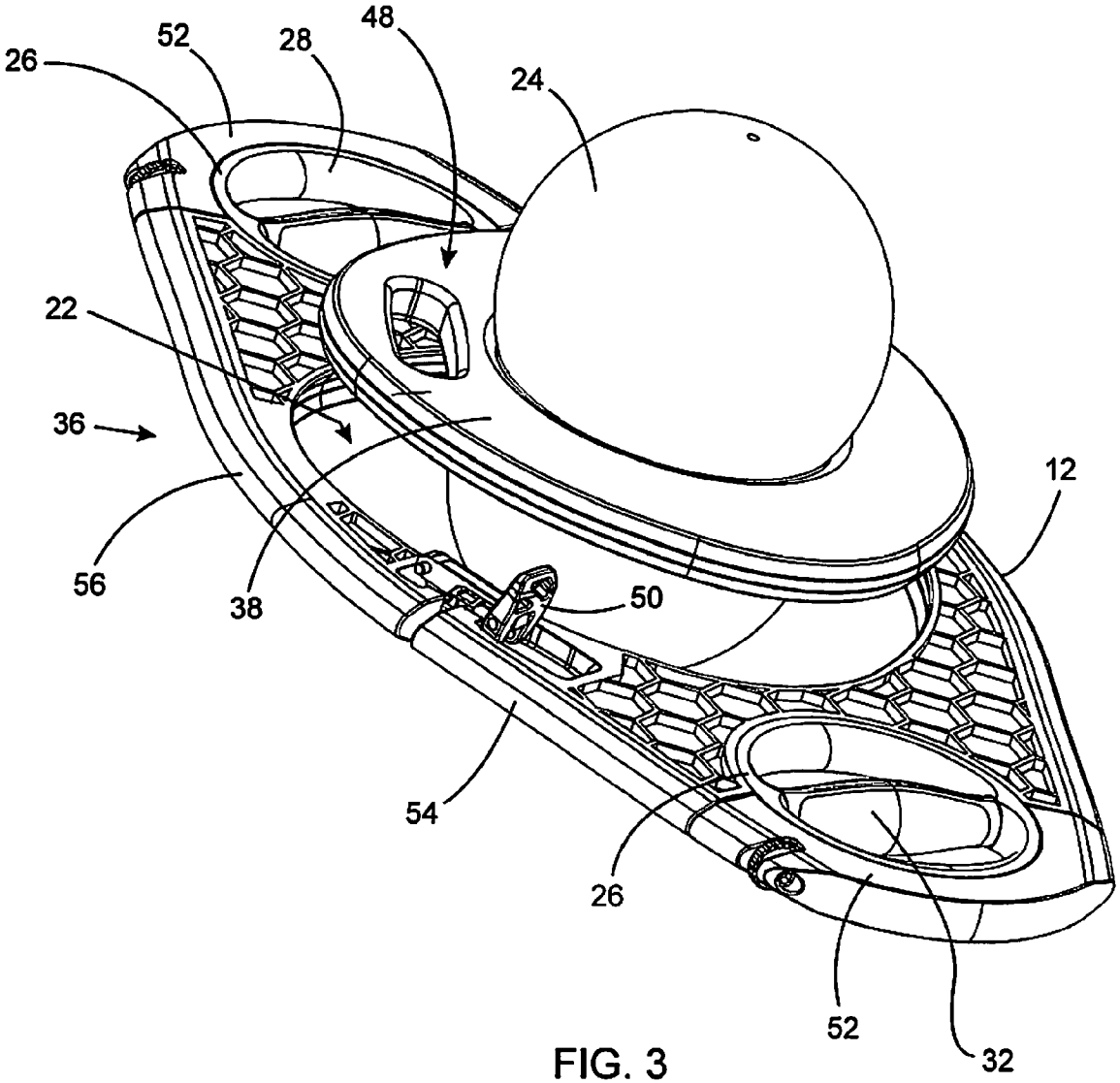
FIG. 3 is a perspective view of one embodiment of the disclosed technology.
Figure 8:
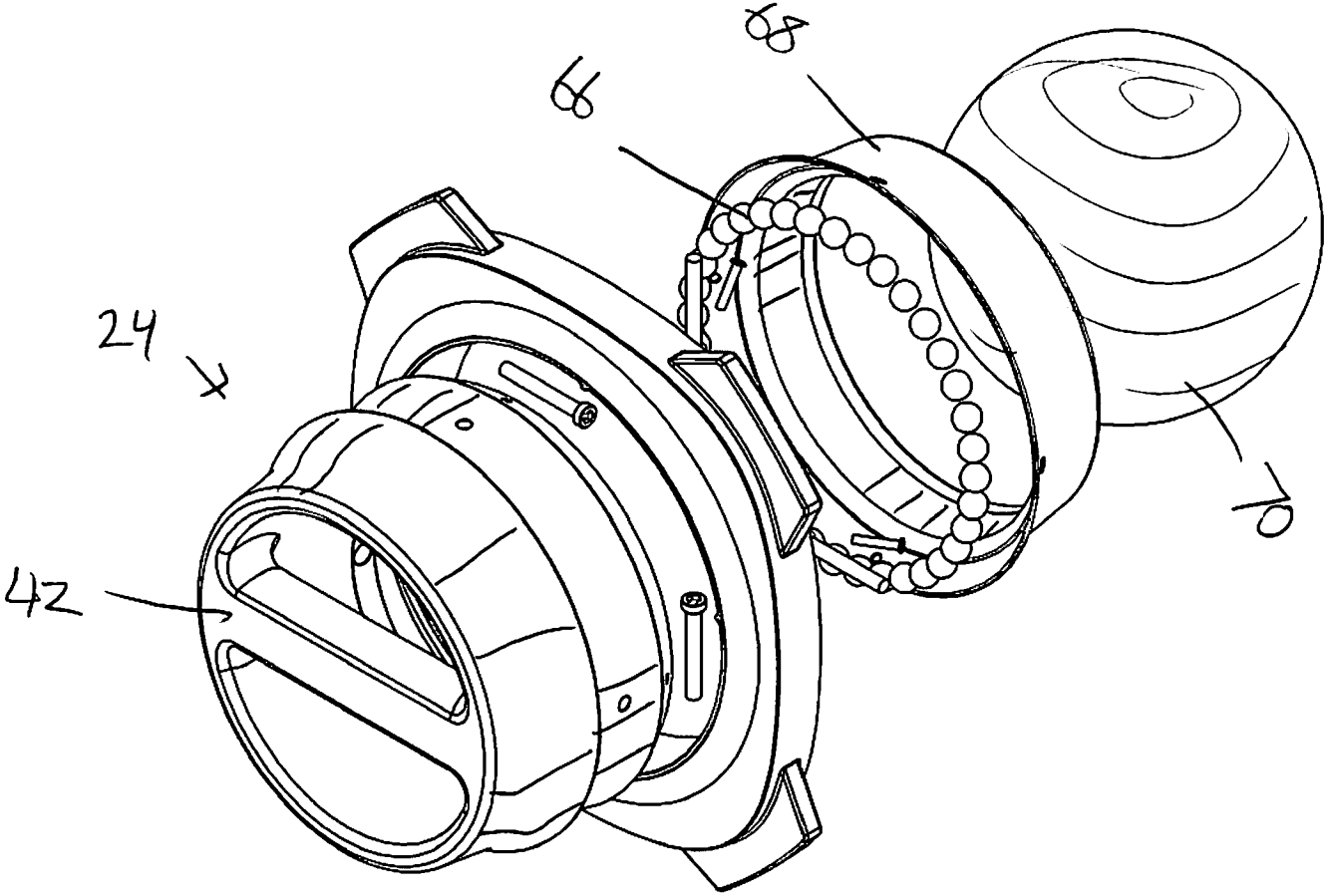
FIG. 8 is an exploded view of the roller ball version of center module.

Referring to FIG. 3, the fitness device can include a center module 24 in the form of an inflatable "FIG. 8" shaped ball (the bounce ball) that features a ring at its narrowest point. The ring allows the ball to be secured to the deck 12. FIG. 3 is an embodiment of the device and includes a center module similar to that shown in FIG. 1. It also includes a ring structure 38, which fits into a mounting means 36. In this case the ring structure 38 is larger than that shown in FIG. 1 and includes a hand grip 48. In the view shown in FIG. 3, the deck is formed of a first half 54 and a second half 56, with the two halves locked together by a cam lock 50. In this particular embodiment the cam lock 50 is part of the mounting means 36, and because it reduces the circumference of the through passage 22, it thus locks the deck 12 more tightly around the ring structure 38. The version shown in FIG. 3 also includes end pieces 52 which are attachable and removable from the deck. The end pieces 52 sandwich the selected lateral exercise accessory 28 into the lateral receiver position 26. In this case, the hand grip 32 is the selected lateral exercise accessory 28.

Additionally, the exercise device can include removable elastic resistance bands that fit into clip structures or grooves at the bottom of the unit and through the handles at either side. This feature allows users to easily hold onto the fitness device as they jump, using bands held in the hands and attached to the deck. It also allows them to engage in strength-training exercises, such as bicep curls and deltoid raises.

Figure 4:
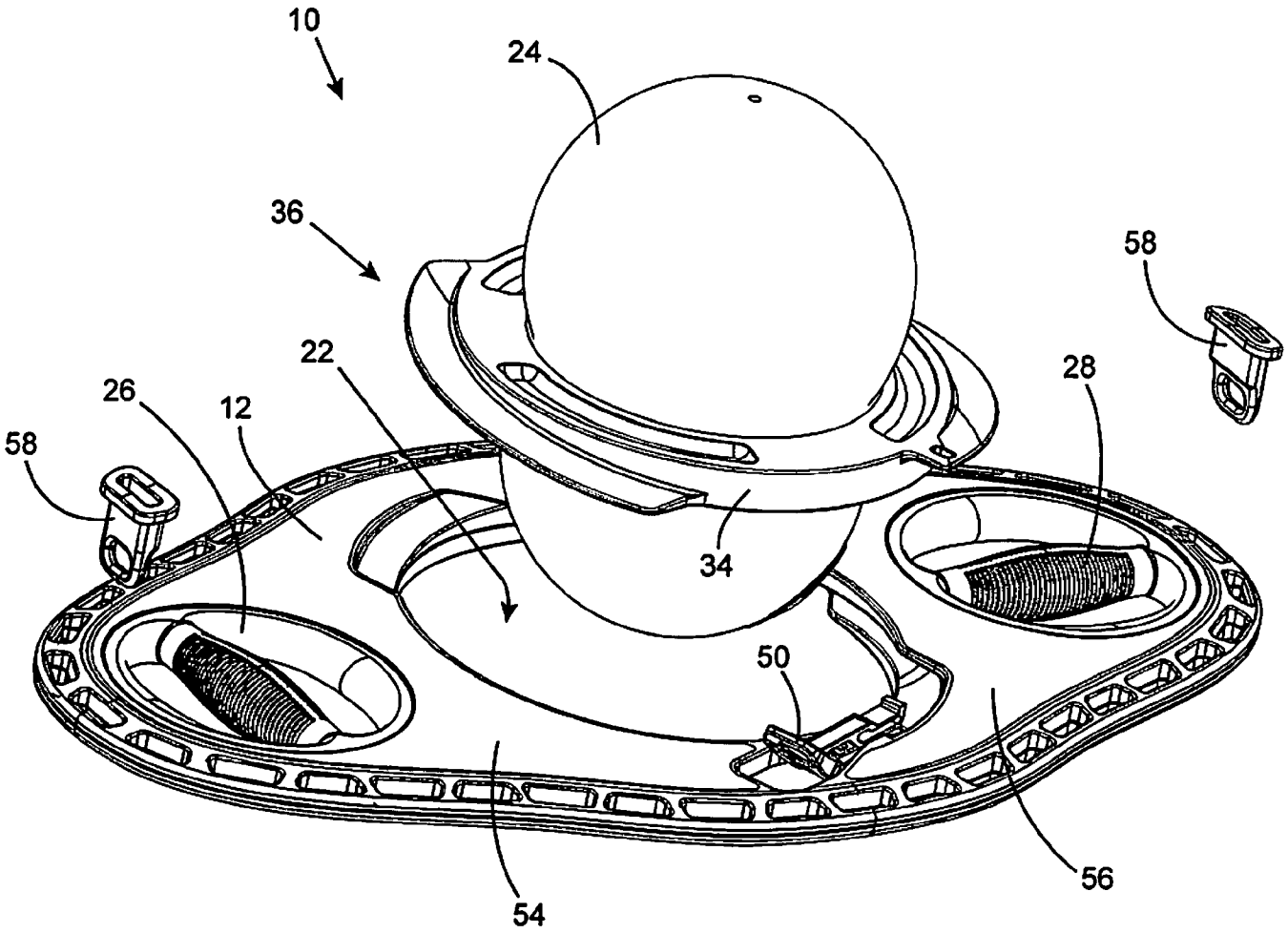
FIG. 4 is a perspective view of an embodiment of the disclosed technology.

FIG. 4 shows a variation of the exercise board 10 which includes a center module 24 which in this case extends above as well as below the deck 12. The mounting means 36 in this case is a pair of arcuate tabs which fit into corresponding slots and allow the mounting ring 34 to be rotated a partial turn in order to secure it into the through passage 22 of the deck 12. The version shown in FIG. 4 also includes a first half 54 and a second half 56 of the deck 12 which as in the case of the device shown in FIG. 3. Cam lock 50 secures the mounting ring 34 in place securely and joins the first half 54 with the second half 56. Shown in FIG. 4 are lateral exercise accessories 28 which are similar to those previously shown. Also shown in FIG. 4 are band anchors 58. The band anchors 58 clips into place on the deck, and allows the attachment of resilient exercise bands. The exercise bands can be utilized with handles on one end for such exercises as bicep curls, deltoid raises, or other exercises which can act against these bands.

Figure 5:
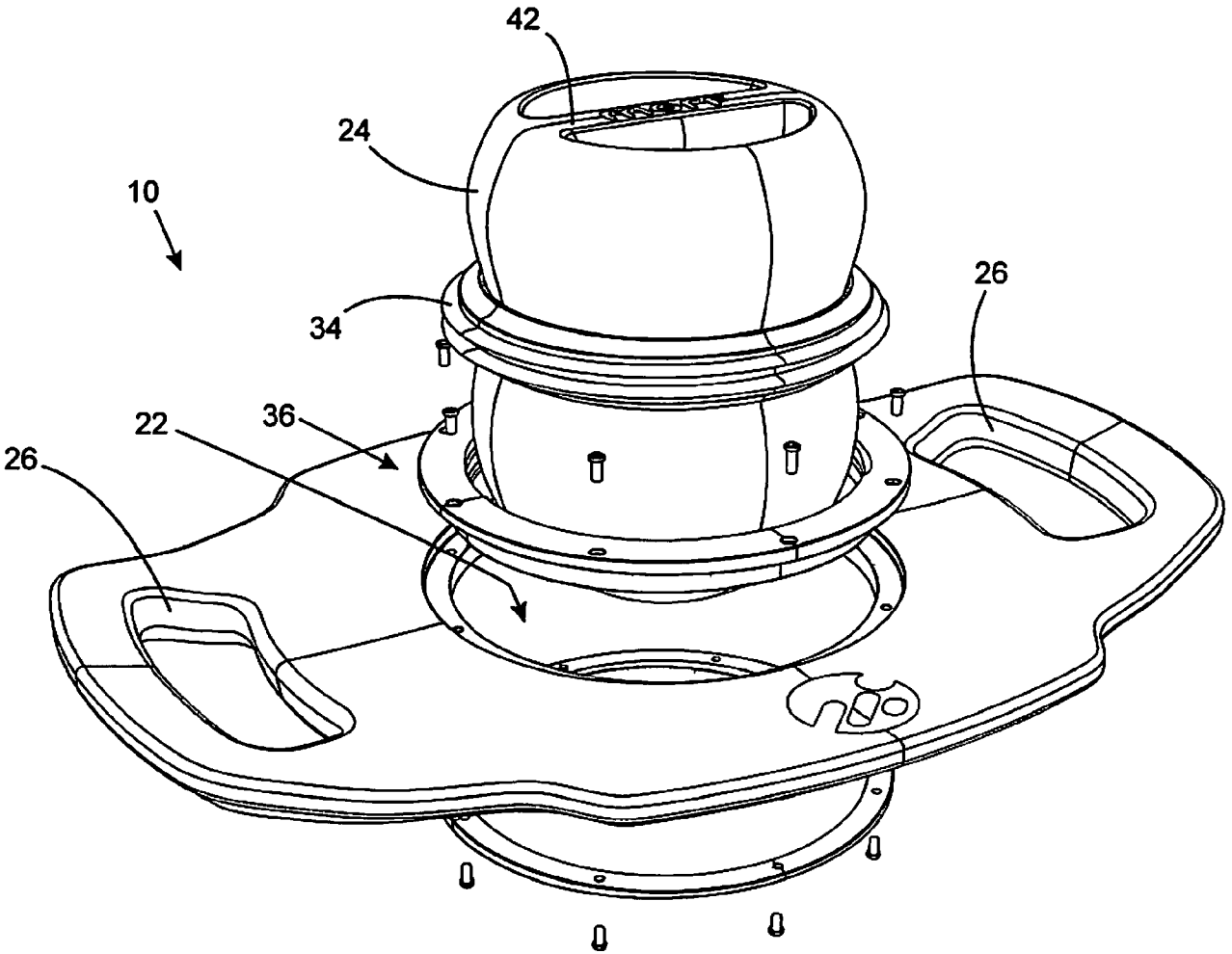
FIG. 5 is an exploded perspective view of an embodiment of the disclosed technology.

FIG. 5 shows another version of the exercise device 10 which includes a center module 24 with a mounting ring 34 which is part of a mounting means 36. This device includes a through passage 22, and in this case the lateral receiver positions 26 are without a lateral exercise accessory and form hand grips by themselves. The upper portion of the center module 24 includes a hand grip 42.

Figure 6:
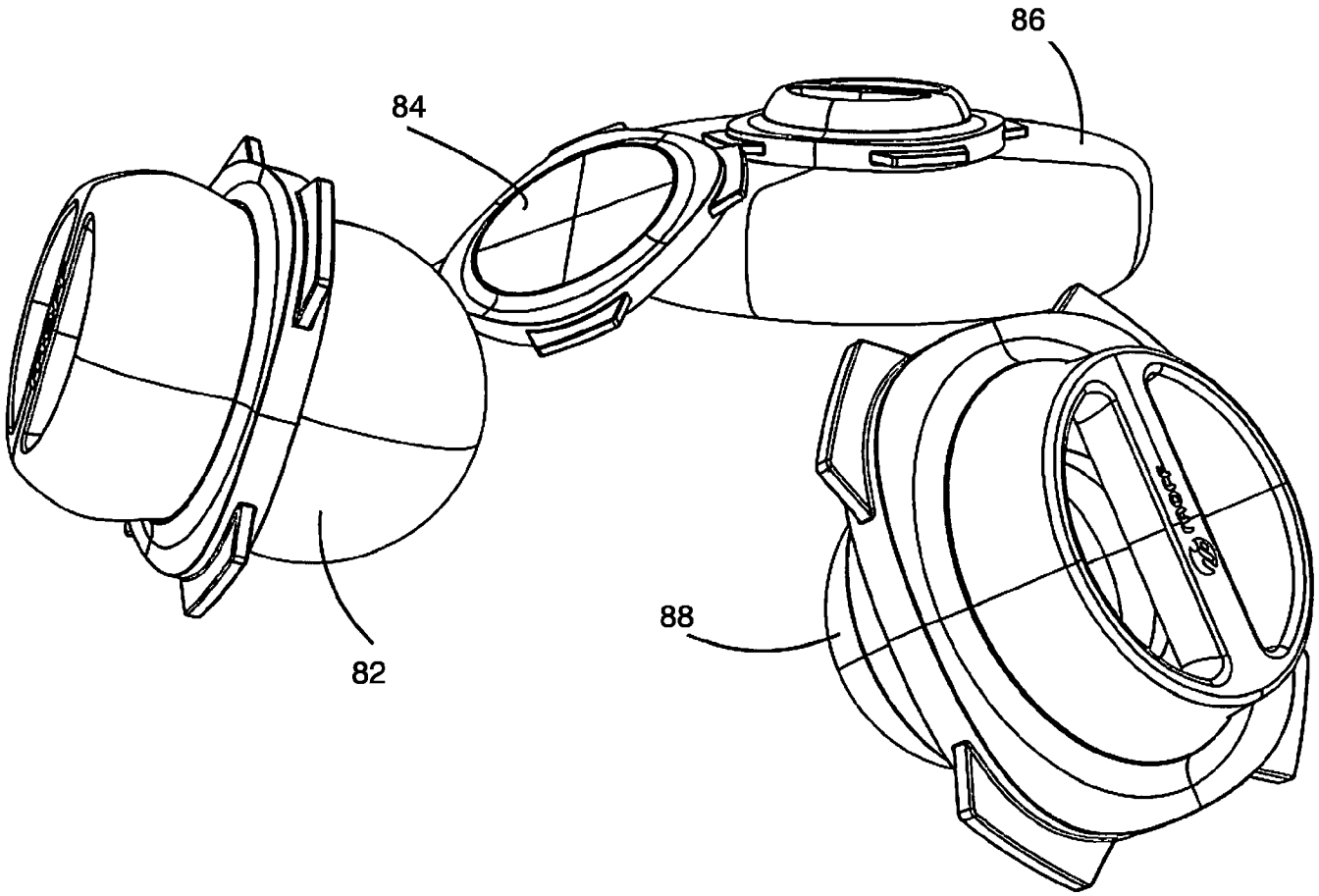
FIG. 6 is an embodiment of certain center modules of the disclosed technology.

FIG. 6 shows a number of center modules 24 including some that protrude above and below the deck, some that are flush with the deck, some that protrude only below the deck and some that protrude only above the deck are also possible. The center module 24 on the left is a bounce ball 82, the next to the right is a deck plug 84, at the top left is a halo destabilizer 86, and the center module on the lower right is an ab roller 88, which has a rotating ball on one side of the center module, which can roll in any direction on the floor. A version of the bounce ball is one in which mechanical devices such as springs are included, to enhance the energy returned to the user in the form of bounces. This version of the bounce ball is called an aggressive bounce ball.

FIG. 6, middle figure shows an optional center module called the halo destabilization module 86. The function of the halo destabilization module 86 is to create a moderate and variable unstable surface that increases difficulty, develops and improves stability and strength through a wide range of upper and lower body exercises. The user can stand on the deck with the halo destabilization module in place, and do such exercises are bicep curls with free weights. While he is doing other exercises, he has to balance on the wobbling and unstable deck, so he is working on core muscles at the same time as doing bicep curls, as one example. He can also do pushups with the halo destabilization module 86 in place, and get a different workout than regular pushups, due the need to use more muscles to balance on the constantly shifting deck. The material of the halo destabilization module would typically be a softer and more flexible material, and could be a solid foam or a soft inflated shape.

Figure 7:
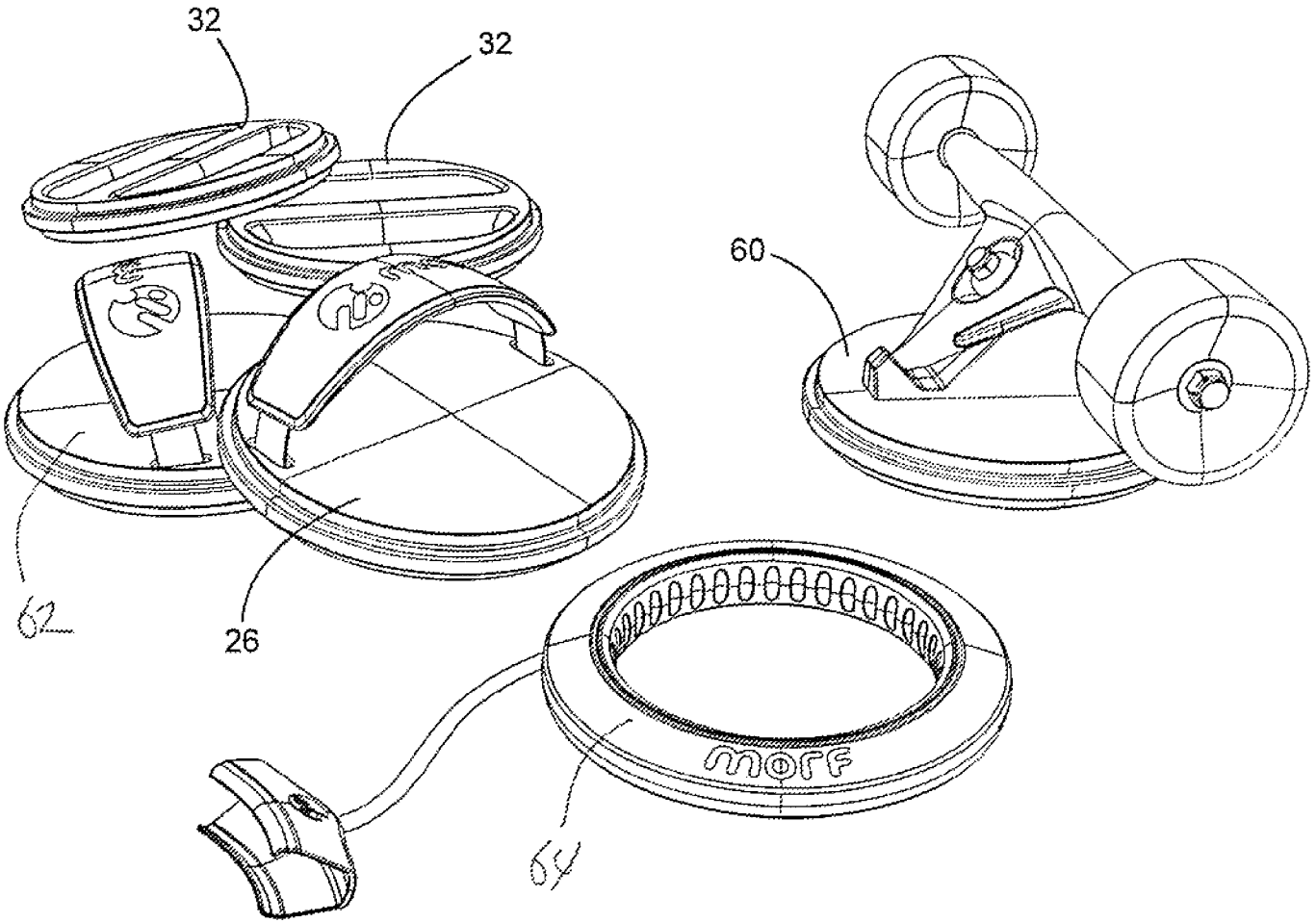
FIG. 7 is a perspective view of certain lateral exercise accessories.

FIG. 7 shows several forms that the lateral exercise accessories 28 can take including skate board truck 60, foot strap 62, hand grips 32, and band attachment ring 64. The lateral exercise accessory can also be a deck plug, which is the foot strap unit 62, but without the foot strap itself. The ring with the attached band is a spooled band system that attaches at the lateral positioning points and allows the user to adjust the bands' resistance level and length. the bands are for resistance and strength training. The clip on the end attaches to a handle.

Figure 9:
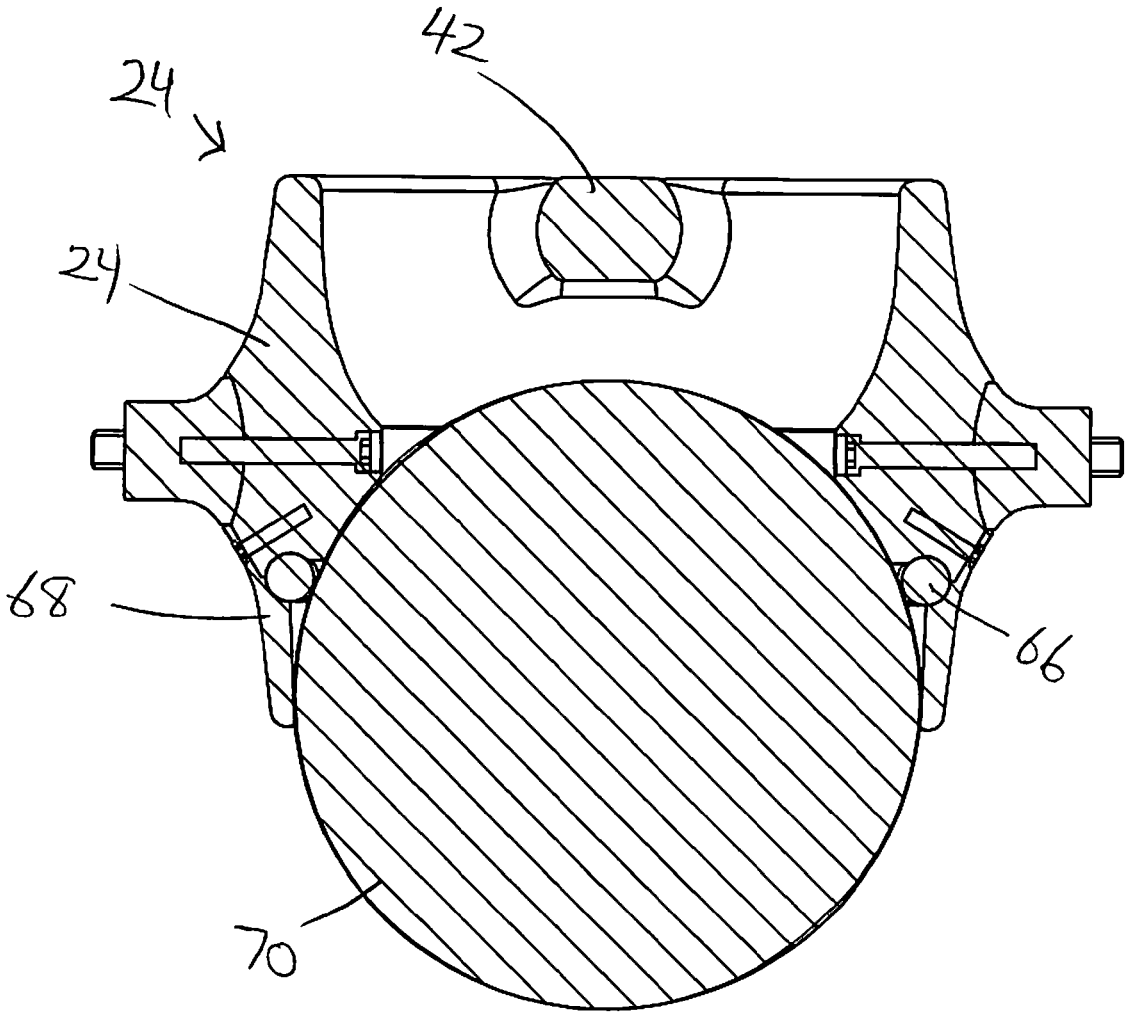
FIG. 9 is a cross sectional view of the roller ball version of center module.

FIG. 8 shows an exploded version of the center module which is a roller ball. The roller ball can support the deck, and can be moved in any direction. This could be used for ab roll outs, where the user has her knees on the floor, and pushes the device forward to full extension, and pulls it back using abdominal muscles with the ball rolling moving under the user's direction. This is a great core workout. The ab roller or roller ball is secured by a housing 68 that contains a horizontal bearing 64. This is the same device as shown in the right hand graphic in FIG. 6. FIGS. 8 and 9 show more details of the ab roller, or roller ball. The ball used in the ab roller is a preferably a spherical ball of much harder consistency than the inflatable ones in other center modules shown in FIG. 6. The roller ball 70 is trapped by a housing 68 as it comes lower the widest part of the ball 70, and can use ball bearings 64 or other bearings such as smooth plastic or Teflon to allow the captured ball to roll. The free movement is allowable through the ball interaction with a horizontal bearing 64 that surrounds the ball. The housing 68 that encases the roller ball and the surrounding bearing is opened from the top. This allows for dirt and debris to be cleaned out easily. This configuration of center modules is for core exercises and strength training As the ball moves in every direction, it makes contact with the bearing for a smooth rotation of the ball.

An important feature of the disclosed technology is that the center module can be one of several units, the lateral exercise devices can be one of several units, all of which can be selected by the user for the exercise he wants to do.

While certain exemplary embodiments are shown in the FIGS. and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

What is claimed is:

1. An exercise board comprising:

a set of center modules, each center module being interchangeable to provide alternative modes of operation to the exercise board; and a deck comprising:

a top and a bottom surface;

a long axis and a short axis, with the long axis being longer than the short axis;

a through passage at the intersection of the long axis and the short axis, configured for removably mounting a center module of the set of center modules;

a locking mechanism in the deck for locking a mounted center module in a non-rotating position relative to the deck; and two exercise accessory receivers positioned laterally from the through passage on either end of the deck, with each exercise accessory receiver configured for removably mounting an exercise accessory.

2. The exercise board of claim 1, wherein each center module of the set of center modules is selected from the group consisting of a roller ball, a bounce ball, a flush deck plug, a halo destabilizer, and an aggressive bounce ball.

3. The exercise board of claim 1, further comprising an exercise accessory configured for removably mounting in or to one of the exercise accessory receivers, wherein the exercise accessory is selected from the group consisting of a hand grip, a flat disc with a foot strap, a deck plug, a ring with attached resilient bands, and a skateboard truck.

4. The exercise board of claim 1, further comprising an exercise accessory configured for removably mounting in or to one of the exercise accessory receivers, wherein the exercise accessory comprises a rotating ring with a handgrip.

5. The exercise board of claim 1, wherein one center module of the set of center modules comprises a floor contacting base configured to mount in the through passage and to contact a floor surface when the board is in use.

6. The exercise board of claim 1, wherein the through passage further comprises a planar mounting ring which is configured to connect with the locking mechanism, wherein the planar mounting ring is configured to surround a center module that is mounted in the through passage.

7. The exercise board of claim 1, wherein a first portion of the center module extends below the deck and a second portion of the center module is generally level with a top surface of the deck.

8. The exercise board of claim 6, wherein the mounted center module extends above and below the planar mounting ring.

9. The exercise board of claim 1, further comprising an exercise accessory configured for removably mounting in or to one of the exercise accessory receivers, wherein the exercise accessory is a ring with a hand grip attached inside the ring and extending from one side of the ring to the opposite side of the ring to provide a hand grip and space on either side of the hand grip for a user's hand.

10. The exercise board of claim 1, further comprising an exercise accessory configured for removably mounting in or to one of the exercise accessory receivers, wherein the exercise accessory is a skateboard truck.

11. The exercise board of claim 1, further comprising two resilient bands attached to the deck, for use by a user when standing on the deck.

* * * * *